United States Patent [19]

Ferns

[11] 4,126,404

[45] Nov. 21, 1978

[54] GRATING

[75] Inventor: Derek Ferns, Trelleck, Wales

[73] Assignee: Self-Level Covers Aktiengesellschaft, Basel, Switzerland

[21] Appl. No.: 886,689

[22] Filed: Mar. 15, 1978

[30] Foreign Application Priority Data

Mar. 23, 1977 [GB] United Kingdom ..... 12232/77

[51] Int. Cl.[2] ..... E01C 11/22

[52] U.S. Cl. ..... 404/4; 52/664; 210/163; 404/2

[58] Field of Search ..... 404/4, 2, 3, 5; 210/163, 164, 166; 52/664

[56] References Cited

U.S. PATENT DOCUMENTS

| | | | |
|---|---|---|---|
| 699,269 | 5/1902 | Wheeler | 210/163 |
| 1,360,630 | 11/1920 | Fairtrace | 210/164 X |
| 2,305,955 | 12/1942 | Dudley | 210/163 X |
| 2,473,279 | 6/1949 | Crocker | 404/4 |
| 2,607,455 | 8/1952 | Yellin | 52/664 |
| 2,938,437 | 5/1960 | Daley | 404/4 |
| 3,797,188 | 3/1974 | Mansfeld | 404/2 X |

FOREIGN PATENT DOCUMENTS

| | | | |
|---|---|---|---|
| 452,912 | 9/1936 | United Kingdom | 404/5 |

*Primary Examiner*—Nile C. Byers, Jr.
*Attorney, Agent, or Firm*—Young & Thompson

[57] ABSTRACT

A grating to cover a drain for a paved surface such as a road comprises a set of parallel bars interconnected by spacers. In the central part of the grating, adjacent pairs of bars each have only one spacer therebetween, the spacers being positioned alternately at opposite ends of the bars. This allows the grating to be compressed during insertion into a support frame so that, when the force causing such a compression is removed after insertion, lugs on the grating move into locking engagement with the frame.

12 Claims, 7 Drawing Figures

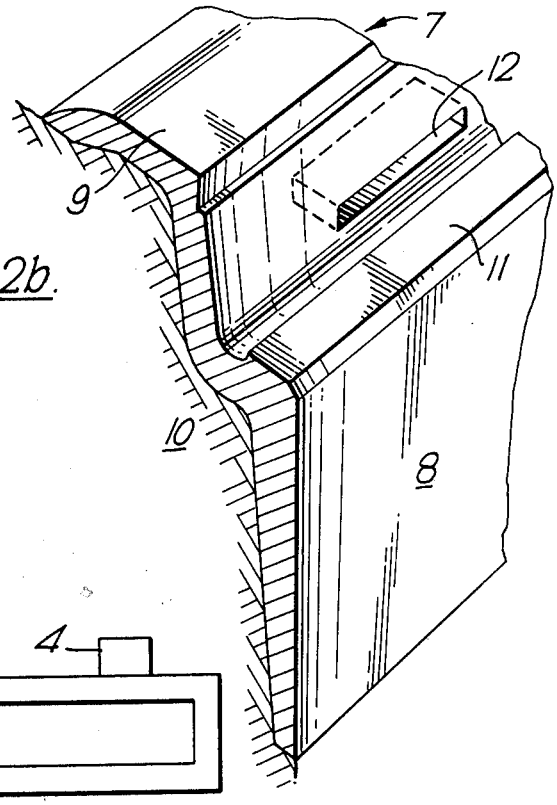
Fig 2b.
Fig.3
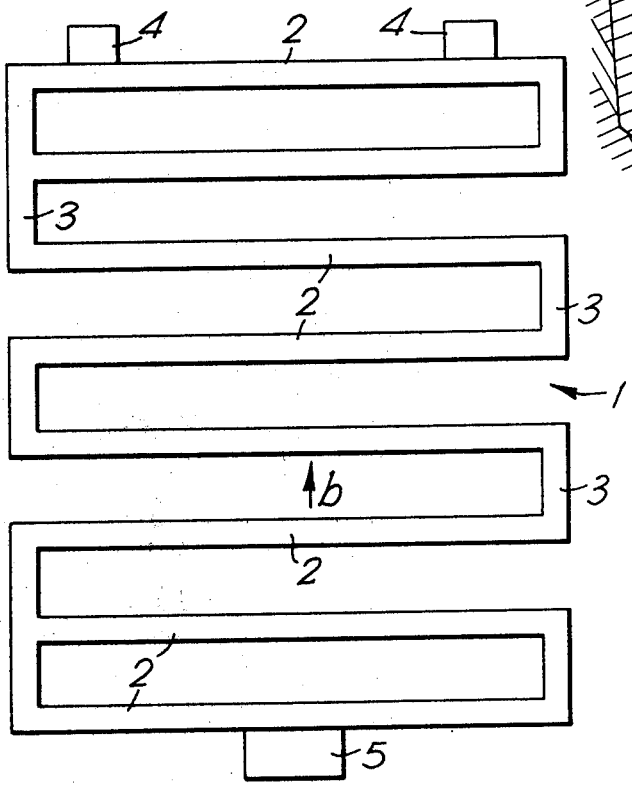

GRATING

This invention relates to a grating (or gully) which is to be supported by means of a support frame at the surface of, for example, a road.

Throughout the rest of this specification gratings will be described as positioned in road surfaces, though it will be understood that they could equally well be positioned in other surfaces, such as playgrounds.

Gratings are normally made of cast iron and can weigh up to between 3 and 5 cwt. Obviously, this is disadvantageous from the point of view of transporting and manhandling such gratings as well as from the point of view of manufacturing costs. Recently, it has been proposed to make gratings from spheroidal graphite iron. This material is much more ductile than cast iron and so can take up the forces applied by the wheels of motor vehicles much more easily. Indeed, gratings made of spheroidal graphite iron and equivalent strength to cast iron covers weighing 3 to 5 cwt., weigh only 15 to 20 lbs. Thus, not only do spheroidal graphite iron gratings use considerably less metal, but they are also much easier for a workman to manhandle into and out of position. Unfortunately, because they are so light, they tend to be "flipped" out of position by the wheels of motor vehicles, particularly if the wheel passes over an edge portion of such a grating.

Another disadvantage of known forms of grating is that they are relatively easy to steal, as the only means by which they are retained in place is the force of gravity.

The present invention provides a grating which is to be supported by means of a support frame at the surface of, for example, a road, the support frame having a hollow, generally cylindrical structure, whose cross-section generally matches that of the cover, and internal support means for supporting the cover so that its top surface is substantially level with the road surface, the grating being constituted by a plurality of spaced bars and a plurality of spacers, wherein the grating is made of such a material and in such a form that is is resiliently compressible whereby the energy stored in the grating by such resilient compression forces, in use, portions of the grating into a locking relationship with complementary portions of the support frame.

Preferably, the grating is provided with locking tabs which mate with complementary slots in the support frame to constitute said locking relationship, at least one tab being provided on each of the bars which constitutes an end of the grating. Alternatively, the tabs may be dispensed with and a friction fit of the grating in the support frame may constitute said locking relationship. It is also possible to provide the grating with locking peg means which project downwardly from, and substantially perpendicular to the underside, the locking peg means being so positioned as to engage the support frame to constitute said locking relationship. Preferably, four locking pegs constitute the locking peg means, the pegs being positioned at the corners of the grating.

Advantageously, at least one spacer is provided between each pair of adjacent bars, the spacers being provided at the ends of the bars and at least one pair of adjacent bars having only one spacer. Preferably, a plurality of adjacent pairs of adjacent bars each have only one spacer, which spacers are positioned alternately at opposite ends of the bars. In this case, each pair of adjacent bars which constitutes an end portion of the grating may be provided with two spacers.

Preferably, the bars are parallel to one another when the grating is not being resiliently compressed.

The grating may be made in one piece from, for example, spheroidal graphite iron or meghanite iron. An additional advantage of using spheroidal graphite iron or meghanite iron, is that these materials are very stable so that a finished product such as a grating does not alter its shape as is the case with cast-iron.

This invention also provides a grating as defined above in combination with a support frame, the support frame being constituted by a hollow, generally cylindrical structure, whose cross-section matches that of the grating, wherein the structure is provided, at the end which is to lie at the level of, for example, a road surface, with an outwardly extending flange, and wherein the structure is provided internally with means for supporting the grating with its top surface substantially level with the road surface.

Two forms of grating constructed in accordance with the invention will now be described, by way of example, with reference to the drawings, in which:

FIG. 1 is a perspective view of the first form of grating;

FIG. 2*a* is a perspective view of part of the grating of FIG. 1 shown in position within part of a support frame;

FIG. 2*b* is a perspective view of another part of the support frame;

FIG. 3 is a plan view of the uncompressed grating of FIG. 1;

Figure 1:
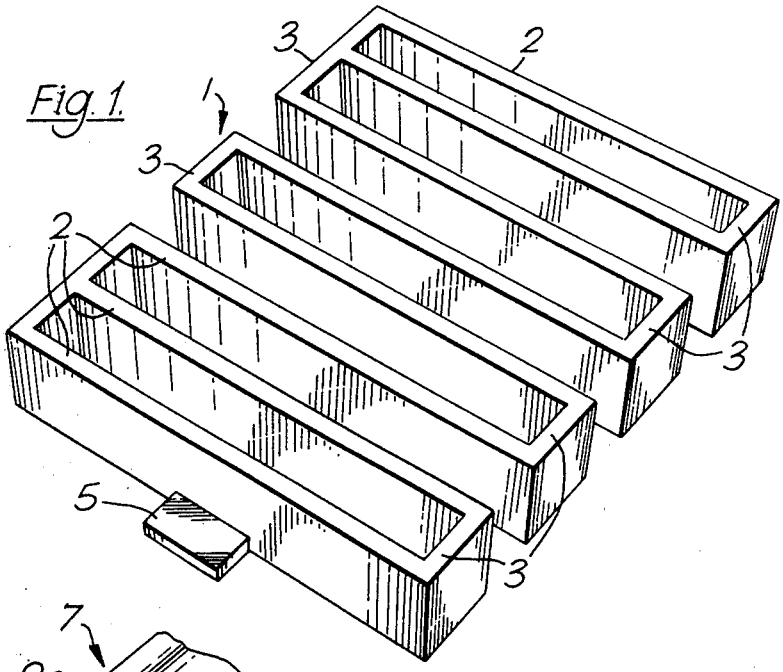

Referring to the drawings, FIGS. 1 to 4 show a grating which is indicated generally by the reference numeral 1. The grating 1 is constituted by a unitary member made of spheroidal graphite iron. The grating 1 has eight bars 2 which are joined at their ends by means of spacers 3. Each pair of bars 2 which constitute an end portion of the grating 1 are joined by two such spacers 3, whereas the other pairs of adjacent bars are joined by only one spacer. As can best be seen in FIG. 3, the spacers 3 associated with the pairs of adjacent bars 2 which form the central part of the grating 1, are positioned at alternate sides of the grating. Two locking tabs 4 are formed on one end of the grating 1, and a single locking tab 5 is formed on the other end of the grating.

Because of the inherent resilience of spheroidal graphite iron and this tortuous formation of its central region, the grating 1 can be compressed in the direction of the arrow 6. This compression is shown in FIG. 4, the normal state of the grating 1 being indicated by the dotted lines.

Figure 2A:
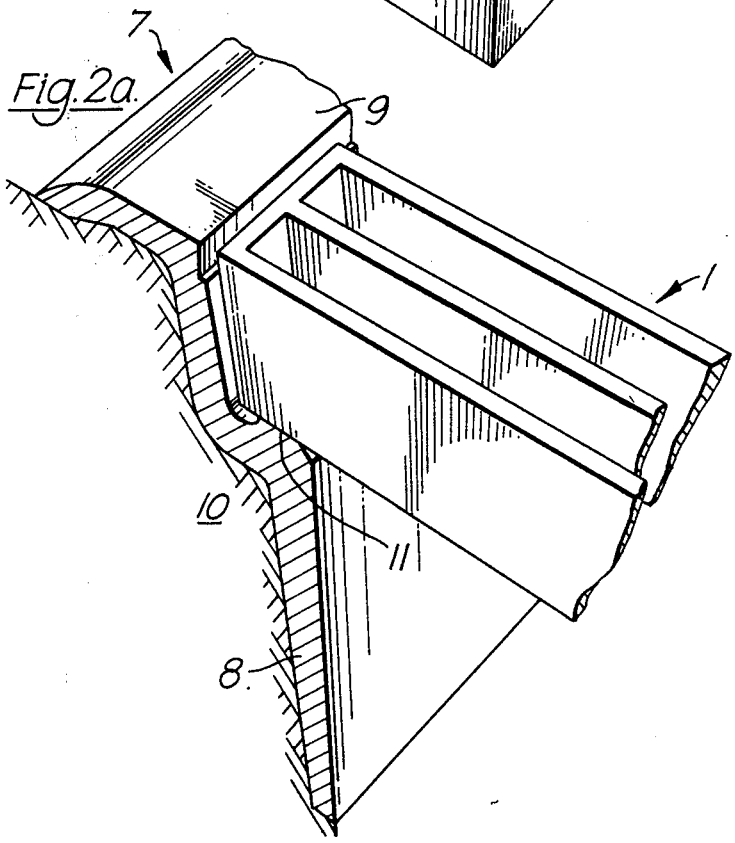

The grating 1 is sized so as to be a good fit within a support frame 7 (see FIGS. 2*a* and 2*b*). This support frame 7 has the same general cross-sectional profile as the grating 1. The support frame 7 has a generally vertical wall 8 provided at its top end with an outwardly extending flange 9. This flange 9 supports the frame 7 on the surrounding road surface 10. A shoulder 11, formed by a stepped portion of the wall 8, constitutes the means for supporting the grating 1. FIG. 2*b* shows that part of the support frame 7 which cooperates with the end of the grating 1 which is provided with the locking tab 5, a slot 12 being formed for mating with this tab. Two similar slots (not shown) are provided at the opposite end of the frame 7 for mating with the tabs 4.

Figure 4:
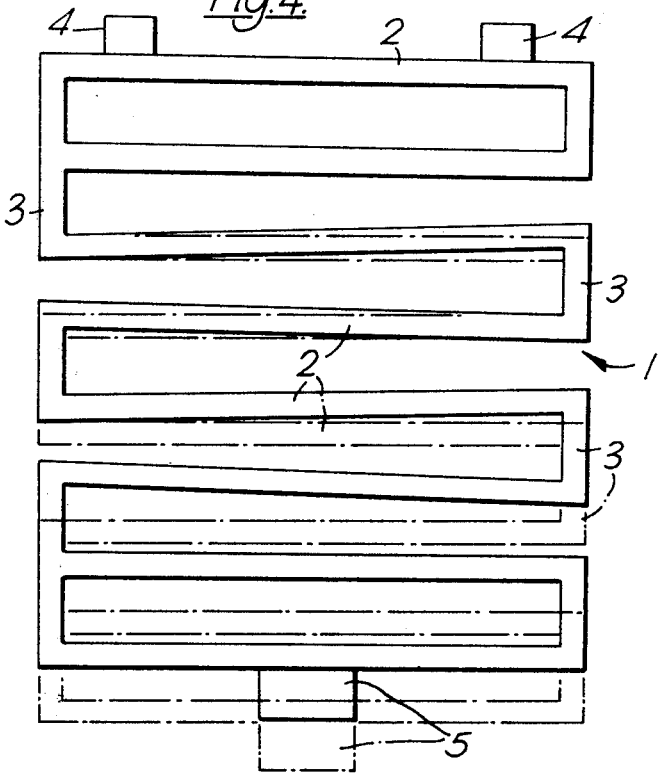
FIG. 4 is a plan view of the compressed grating of FIG. 1.

When it is desired to position the grating 1 within the frame 7, the grating is compressed from the position shown in FIG. 3 (and by the dotted lines in FIG. 4) to the position shown in full lines in FIG. 4. This compression can be carried out in any suitable manner, but conveniently a special lever bar (not shown) will be used for this purpose. When the grating 1 has been so compressed, it can be positioned on the shoulder 11 formed within the frame 7, with the tabs 4 and 5 aligned with the corresponding slots. The force causing the compression is then removed, and the energy stored in the grating 1 forces the tabs 4 and 5 into mating relationship with their slots so as to lock the grating within the frame 7. The grating 1 can then only be removed from the frame 7 by recompression, until it assumes the configuration shown by the full lines in FIG. 4, and then being lifted whilst in this configuration. Consequently, there is no danger of the grating 1 being "flipped" out of its frame 7 by the wheel of a passing motor vehicle. It also hinders removal of the grating 1 by unauthorised persons and so constitutes an anti-theft device.

Figure 5:
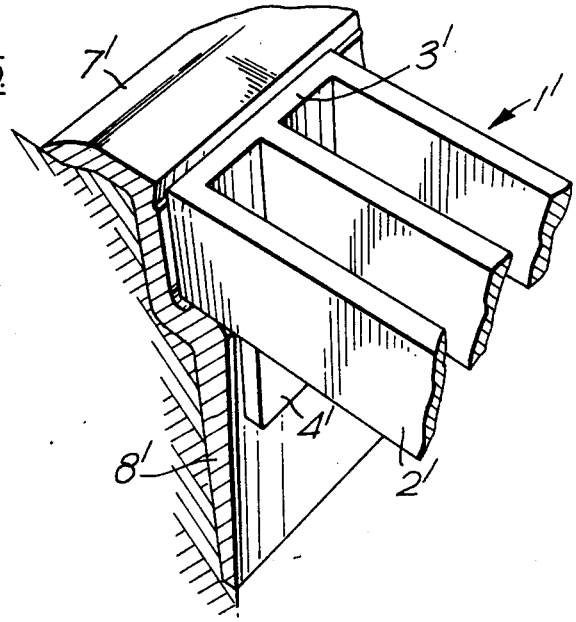
FIG. 5 is a view similar to that of FIG. 2*a* and shows the second form of grating within part of a support frame.
Figure 6:
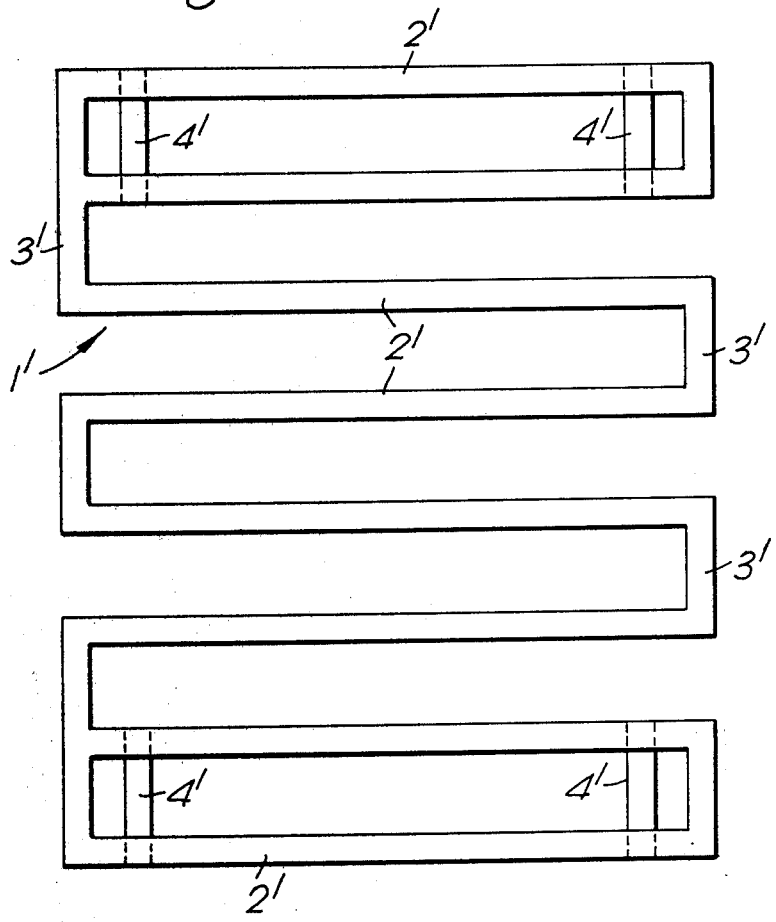
FIG. 6 is a plan view of the uncompressed grating of FIG. 5.

FIGS. 5 and 6 show a modified form of grating 1'. As this grating 1' is very similar to the grating 1 it will not be described in detail, but like parts will be given the same reference numerals primed. Thus, the grating 1' is provided with four locking pegs 4' which are situated adjacent to the corners of the grating. Each of the locking pegs 4' projects downwardly from the underside of the grating 1' and is positioned parallel to one of the spacers 3' associated with one end pair of bars 2'. Thus, when the grating 1' is compressed, it can easily be positioned within the frame 7' its locking pegs 4' are forced into engagement with the walls 8' of the frame 7'. The locking pegs 4' have such a length, typically 60 mm, that the grating 1' is removable from the frame 7' only by moving the grating substantially vertically upwards and so prevents the grating 1' being "flipped" out of the frame by the wheel of a passing motor vehicle. Moreover, these locking pegs 4' have an additional locking junction owing to the fact that they engage the walls 8' of the frame 7' as a friction fit.

Frames of the type denoted by the reference numeral 7 or 7' are described in greater detail in the specification of my copending application Ser. No. 882,386, filed Mar. 1, 1978.

I claim:

1. A grating in combination with a support frame adapted to support the grating in a paved surface, the support frame having a hollow structure, whose cross-section generally matches that of the grating, and internal support means for supporting the grating so that its top surface is substantially level with the paved surface, the grating being constituted by a pair of end bars, a plurality of intermediate bars spaced between the end bars, a plurality of spacers and locking formations on the end bars, the spacers being positioned to provide a tortuous path for transmission of thrust perpendicular to the bars and the grating being made of a material such that the grating is resiliently compressible whereby the energy stored in the grating by such resilient compression forces, in use, retains said locking formations in engagement with the support frame.

2. A grating according to claim 1, wherein at least one spacer is provided between each pair of adjacent bars, the spacers being provided at the ends of the bars, and at least one pair of adjacent bars having only one spacer.

3. A grating according to claim 2, wherein a plurality of adjacent pairs of adjacent bars each have only one spacer, which spacers are positioned alternately at opposite ends of the bars.

4. A grating according to claim 2, wherein each pair of adjacent bars which constitutes an end portion of the grating is provided with two spacers.

5. A grating according to claim 1, wherein said locking formations comprise locking peg means projecting downwardly from, and substantially perpendicular to, the underside of the grating, the locking peg means being so positioned as to engage the support frame to constitute said locking relationship.

6. A grating according to claim 5, wherein four locking pegs constitute the locking peg means, the pegs being positioned at the corners of the grating.

7. A grating according to claim 6, wherein each locking peg lies parallel and adjacent to a respective one of the spacers provided between the bars of one of an adjacent pair of bars constituting an end portion of the grating.

8. A grating according to claim 1, wherein said locking formations comprise locking tabs which mate with complementary slots in the support frame to constitute said locking relationship, at least one tab being provided on each of the end bars.

9. A grating according to claim 1, wherein the bars are parallel to one another when the grating is not being resiliently compressed.

10. A grating according to claim 1, wherein the grating is made in one piece.

11. A grating according to claim 1, wherein the grating is made of spheroidal graphite iron.

12. A grating according to claim 1, wherein the grating is made of meghanite iron.

* * * * *